US005360487A

United States Patent [19]

Sepe

[11] Patent Number: 5,360,487

[45] Date of Patent: Nov. 1, 1994

[54] AUTOMATIC TRANSMISSION VALVE BODY CLEANING ACCESSORY

[76] Inventor: Patrick Sepe, 22-42 Merrick Rd., Merrick, N.Y. 11566

[21] Appl. No.: 16,762

[22] Filed: Feb. 11, 1993

[51] Int. Cl.[5] ..... B08B 3/02

[52] U.S. Cl. ..... 134/22.1; 134/169 A; 134/201

[58] Field of Search ..... 51/310, 311, 262.1, 51/274; 132/317; 156/654, 656; 134/24, 25.4, 41, 42, 169 A, 201, 166 R, 22.1

[56] References Cited

U.S. PATENT DOCUMENTS

| | | | |
|---|---|---|---|
| 2,357,310 | 9/1944 | Burchell | 51/312 X |
| 2,516,197 | 7/1950 | Fox | 51/312 |
| 3,624,966 | 12/1971 | Palmer | 51/310 X |
| 4,563,948 | 1/1986 | Cafferty | 51/312 X |
| 5,052,155 | 10/1991 | Black et al. | 51/310 |
| 5,131,110 | 7/1992 | Hadgis | 51/310 |

FOREIGN PATENT DOCUMENTS

| | | | |
|---|---|---|---|
| 59-26736 | 2/1984 | Japan | 51/311 |
| 613906 | 5/1978 | U.S.S.R. | 51/310 |

*Primary Examiner*—Frankie L. Stinson
*Attorney, Agent, or Firm*—Collard & Roe

[57] ABSTRACT

A template for use in cleaning a valve body assembly for an automatic transmission has hydraulic passageways, at least one spring-loaded valve, and fasteners for the valve. A solid sheet has a perimeter having a lip and protrusions extending from it and covering and protecting the spring-loaded valve and the fastener means for the valve of the assembly. The template has a cut-out interior portion which exposes the hydraulic passageways for the cleaning thereof.

7 Claims, 2 Drawing Sheets

AUTOMATIC TRANSMISSION VALVE BODY CLEANING ACCESSORY

BACKGROUND OF THE INVENTION

1. Field of the Invention

The present invention relates to an accessory for use in the cleaning of valve body assemblies of automatic transmissions. More particularly, the invention relates to a template for expediting the cleaning of valve body assemblies of automatic transmissions.

2. The Prior Art

When an automobile transmission has to be rebuilt, it is removed from the automobile and the cover plate is taken off the valve body, exposing all the passageways. In those passageways are mounted different spring-loaded valves that are held in place by clips or other devices. When the valve body is washed or sprayed, the high pressure cleaning fluid used can damage or dislodge the valves or the clips that hold the valves in place. In order to prevent this, it is necessary to disassemble the entire valve body assembly before cleaning a transmission.

Prior proposals have been suggested to overcome these and related problems, and examples of these prior proposals are as follows.

Stokes, U.S. Pat. No. 3,612,507 discloses a valve assembling apparatus for maintaining the rings of a multi-ring-type compressor valve assembly in place. The apparatus of Stokes consists of a plurality of spacing elements at a predetermined distance from each other. The entire valve assembly sits within such apparatus, thus allowing the spacing elements to fit within the concentric rings of the compressor valve assembly while maintaining the position of the springs and other internal elements that must be precisely placed before closing the valve assembly.

Elder U.S. Pat. No. 5,121,843 teaches the use of a net to hold dishes in place to be cleaned within a conventional dishwasher. Daum et al., U.S. Pat. No. 4,718,441, shows an apparatus for cleaning decorator tips used in pastry and cake decorating.

Eckert et al, U.S. Pat. No. 4,434,012, relates to cleaning flat electronic chips, and Bostic U.S. Pat. No. 3,873,080, relates to a stamp-soaking unit.

The principal object of the invention is to provide an accessory for use in the cleaning of valve body assemblies of automatic transmissions.

An object of the invention is to provide an accessory which assists in cleaning valve body assemblies of automatic transmissions with efficiency, effectiveness and reliability.

Another object of the invention is to provide an accessory for enabling much more rapid and inexpensive cleaning of valve body assemblies of automatic transmissions than is now possible.

BRIEF SUMMARY OF THE INVENTION

In accordance with the invention, a template is used to clean a valve body assembly of an automatic transmission of a vehicle, such as, for example, an automotive vehicle. The template comprises a solid sheet having a perimeter having a lip extending from the perimeter. The lip has protrusions for covering and protecting the spring-loaded valve and the fastening means for the valve of the assembly. The template has a cut-out portion defined by the lip and the cut-out interior portion exposes the hydraulic passageways for cleaning thereof.

In accordance with the invention, a method of cleaning a valve body assembly for an automatic transmission having a cover, hydraulic passageways, spring-loaded valves and fastening means for the valves, the valve body assembly for the automatic transmission having a perimeter containing the spring-loaded valves and the fastening means for the valves, the perimeter having a width and a shape and the valve body assembly having an interior portion contained within the perimeter, the interior portion containing the hydraulic passageways, comprises the steps of removing the cover of the automatic transmission to expose the hydraulic passageways, the spring-loaded valves and the fastening means for the valves contained of the automatic transmission. The perimeter of the valve body assembly is measured to determine the width and the shape thereof. A template having the width and the shape of the perimeter is formed. The template is placed on the perimeter of the valve body assembly in a manner whereby the spring-loaded valves and the fastening means for the valves are covered and concealed, while simultaneously exposing the interior portion of the valve body assembly containing the hydraulic passageways. Finally, the hydraulic passageways are cleaned by applying a cleaning medium to the interior portion of the valve body assembly and applying the cleaning medium to the template, whereby the template protects the spring-loaded valves and the fastening means from the cleaning medium.

BRIEF DESCRIPTION OF THE DRAWINGS

Other objects and features of the present invention will become apparent from the following detailed description considered in connection with the accompanying drawings, which disclose an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
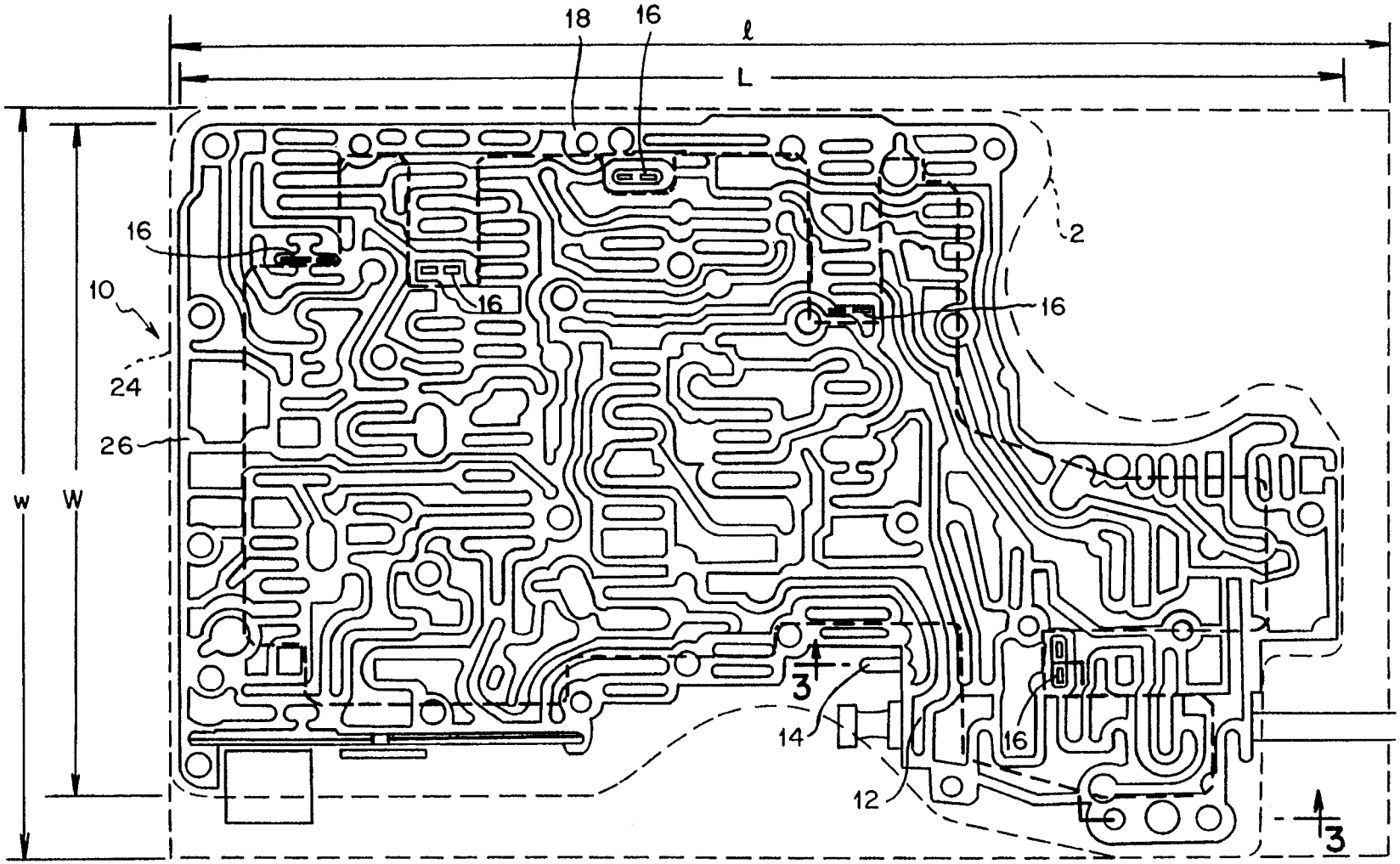
FIG. 1 is a top plan view of an embodiment of a valve body assembly of an automatic transmission.
Figure 2:
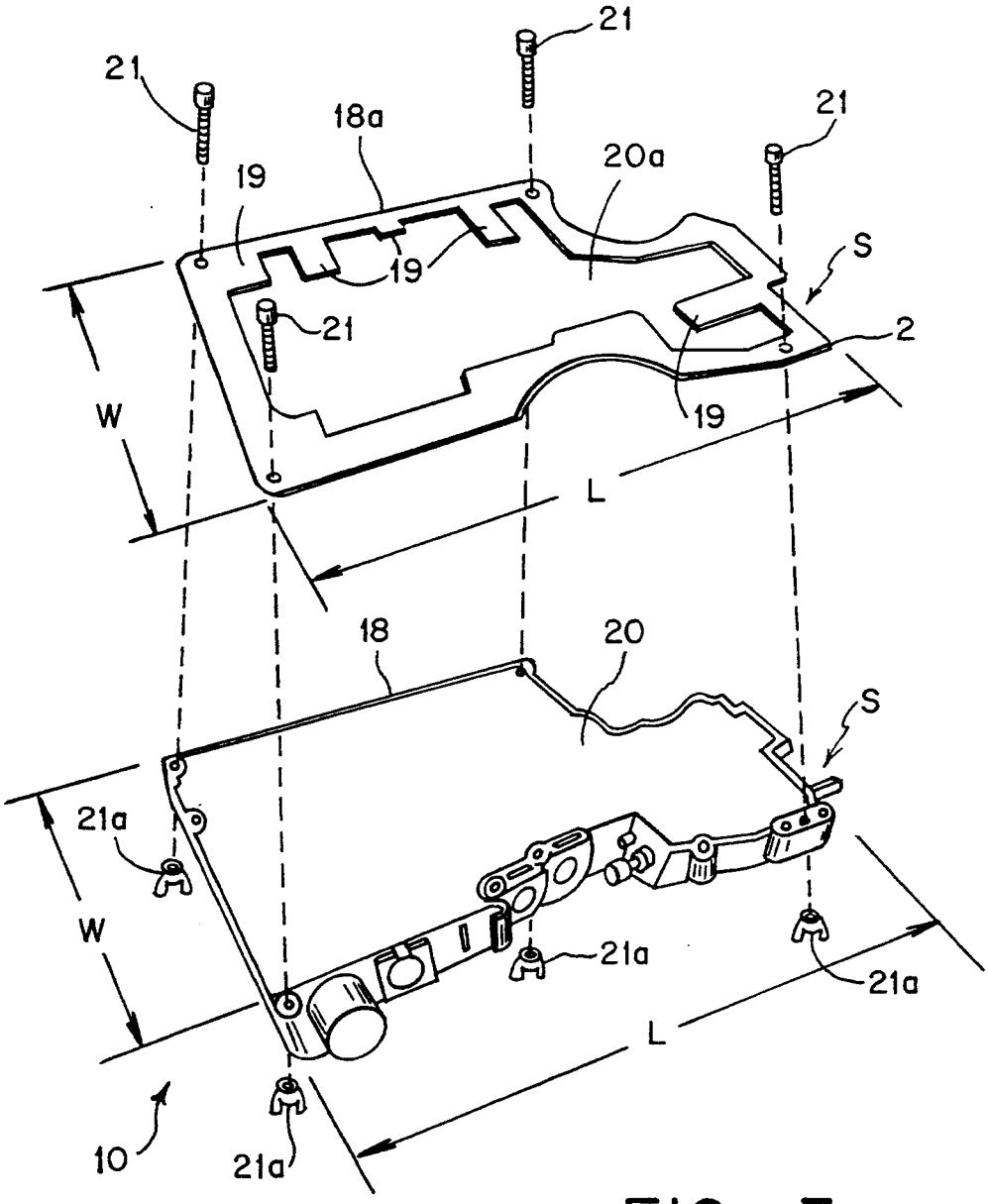
FIG. 2 is a perspective view, on a reduced scale, of an embodiment of a template of the invention shown in relation to the valve body assembly of FIG. 1.

In FIGS. 1 and 2, a template 2 is utilized, in accordance with the invention, with a valve body assembly 10 for an automatic transmission having hydraulic passageways 12, spring-loaded valves 14 having springs 15 and fasteners 16 for these valves during the cleaning of this assembly.

First, the cover (not shown in the FIGS.) of the automatic transmission is removed to expose the hydraulic passageways 12, the spring-loaded valves 14 and the fasteners 16 for the valves of said automatic transmission. The hydraulic passageways 12 are shown in detail in FIG. 1, but are omitted from FIG. 2, in the interest of clarity of illustration.

The valve body assembly 10 of the automatic transmission has a perimeter 18 which contains the spring-loaded valves 14 and the fasteners 16 of the valves. The perimeter 18 has a width W and a shape S (FIG. 2). The perimeter 18 is measured to determine its width W and shape S.

The perimeter 18 of the valve body assembly 10 has an interior portion 20 which contains the hydraulic passageways 12. The template 2 is formed with a width W and a shape S corresponding to the dimensions of the perimeter 18. The template 2 has a perimeter 18*a* and cut-out interior portion 20*a* (FIG. 2), and is placed on the perimeter 18. The template 2 has a lip 19 having specifically located protrusions 19*a* to cover and to protect each of the spring-loaded valves 14 and the fasteners 16 for the valves, while simultaneously exposing the interior portion 20 of the valve body assembly 10 containing the hydraulic passageways 12. Each protrusion 19*a* resembles a solid projection extending integrally with the lip 19 into the cut-out interior portion 20*a* of the template 2. The total number of protrusions 19*a* corresponds to the total number of valves 14 and fasteners 16 to be protected.

The hydraulic passageways 12 are cleaned by applying cleaning means of any suitable type, such as, for example, a cleaning fluid to the interior portion of the valve body assembly 10 and to the template 2, but preventing said cleaning means from contacting the perimeter 18, via said template, in order to protect the spring-loaded valves 14 and the fasteners 16 from said cleaning means.

Figure 3:
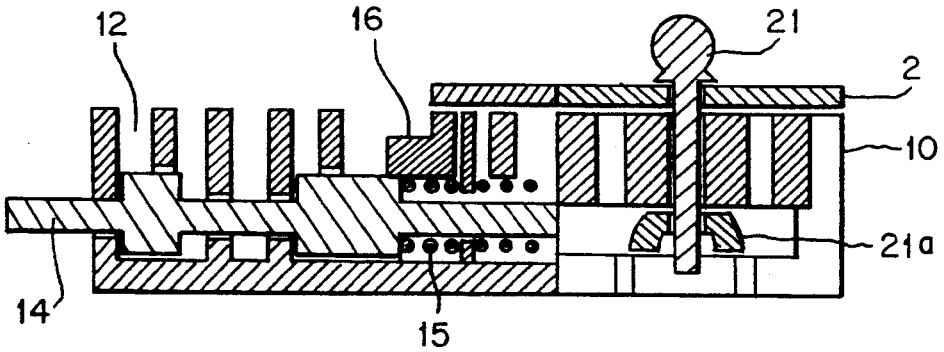
FIG. 3 is a view, partly in section, taken along the lines 3—3 of FIG. 1.

As shown in FIG. 3, the template 2 is preferably fastened to the perimeter 18 by bolt type fasteners 21 and corresponding wing nuts 21*a*, which bolts fit through correspondingly aligned openings through said template and through said perimeter 18.

Forming the template 2 involves providing a solid workpiece 24. The workpiece 24 is of indefinite length 1 and indefinite width w, said length being greater than the length L of the perimeter 18, and said width being greater than the width W of said perimeter (FIG. 2). Preferably, the workpiece is initially made of any suitable known translucent material, such as, for example, clear paper, transparent plastic, or the like, so that it may be seen where to mark around the edge to lay out the perimeter 18*a* and the interior portion 20*a*.

The workpiece 24 is then cut down to substantially conform to the perimeter 18 length L and said perimeter width W. Last, enough of the inner part of the workpiece 24 is removed to expose the interior portion 20 of the valve body assembly 10. The resultant template 2 can be used to produce a final metal template that is of high-enough temperature strength and impact resistance to be placed on the valve body assembly. The final template 2 is of any suitable known material, such as, for example, a strong, lightweight, corrosion-resistant metal, such as, for example, aluminum, or magnesium. The cleaning means can be high pressure steam, or boiling water under pressure.

When a valve body assembly is uncovered for maintenance, all the internally positioned elements and valves are exposed. This includes the hydraulic passageways, spring-loaded valves and their fasteners. The protrusions 19*a* of the template 2 fit over the valves and fasteners and protect and prevent said valves and fasteners from dislodging during cleaning and maintenance of the transmission. Since each model of vehicle uses a different transmission design, a different template 2 is required for each different model. The template 2 is designed to permit the cleaning of the plurality of hydraulic passageways which enable the automatic transmission to shift gears, depending on different hydraulic pressures and the valves involved, while simultaneously protecting the valves and fasteners from the cleaning means or fluid.

In order to make different templates for the different valve body assemblies of different makes of cars, the necessary measurements made are based on the open-faced valve body assembly for a specific make and model vehicle. It is necessary that the template fit over the valve body assembly 10. The template 2 is temporarily bolted into place using the bolts 21 and the wing nuts 21*a* and is therefore held snugly on the face of the valve body assembly 10 via said bolts, which are fitted into four bolt holes at the corners of said template and said nuts. The template 2 covers the critical elements of the valve body assembly 10, such as spring-loaded valves, or clips, or other loose parts that might be otherwise dislodged or damaged while said valve body assembly is being cleaned. Accordingly, it is not necessary to try to disassemble the entire valve body assembly 10, which is a time-consuming and tedious job, before cleaning the assembly. Instead, one can merely spray the combination of the valve body assembly 10 and the template 2 with high-pressure cleaning means or fluid and said template covers parts which need not be cleaned and protects said parts from cleaning.

After cleaning, the template 2 is removed from the face of the valve body assembly 10 and said valve body assembly is re-covered and remounted in the transmission of the vehicle. The transmission is then reinstalled in the vehicle.

While only a single embodiment of the present invention has been shown and described, it is to be understood that many changes and modifications may be made thereunto without departing from the spirit and scope of the invention as defined in the appended claims.

What is claimed is:

1. An accessory for use in cleaning a valve body assembly of an automatic transmission having hydraulic passageways, at least one spring-loaded valve, and fastening means for said valve, said accessory comprising:

a solid sheet template having a perimeter having a lip extending from said perimeter, said lip having protrusions for covering and protecting said spring-loaded valve and said fastening means for said valve of said assembly; and a cut-out portion defined by said lip and said protrusions, said cut-out portion exposing said hydraulic passageways for cleaning.

2. A template as claimed in claim 1, wherein said protrusions comprise solid projections.

3. A template as claimed in claim 2, wherein said protrusions are integral with said lip.

4. A template as claimed in claim 1, wherein said sheet comprises substantially rigid material.

5. A template as claimed in claim 1, wherein said sheet comprises substantially rigid, corrosion-resistant material.

6. A method of cleaning a valve body assembly of an automatic transmission having hydraulic passageways, spring-loaded valve means and fastening means for said valve means, said method comprising the steps of:

exposing said valve body assembly;

masking selected ones of said valve means and said fastening means of said valve body assembly and permitting said hydraulic passageways to remain exposed; and applying cleaning material to said valve body assembly whereby said exposed hydraulic passageways are cleaned and said selected masked valve means and fastening means are sheltered from said cleaning material.

7. A method as claimed in claim 6, wherein said automatic transmission has a cover and further comprising:

the step of removing the cover of the automatic transmission to expose the hydraulic passageways, the spring-loaded valves and the fastening means for said valves of said automatic transmission.

* * * * *